US005156936A

United States Patent [19]

Beghin

[11] Patent Number: 5,156,936

[45] Date of Patent: Oct. 20, 1992

[54] CONTACT DEVICE FOR THE PHOTOCATHODE OF PHOTOELECTRIC TUBES AND MANUFACTURING METHOD

[75] Inventor: Michel E. A. Beghin, Brive la Gaillarde, France

[73] Assignee: U.S. Philips Corporation, New York, N.Y.

[21] Appl. No.: 650,528

[22] Filed: Feb. 27, 1991

Related U.S. Application Data

[62] Division of Ser. No. 409,534, Sep. 19, 1989, Pat. No. 5,038,072.

[51] Int. Cl.[5] ..... G03C 5/00

[52] U.S. Cl. ..... 430/23; 430/313; 430/315; 430/319; 430/321; 430/324; 313/370; 313/372; 313/524; 313/542; 359/341

[58] Field of Search ..... 430/23, 313, 315, 319, 430/321, 324; 313/370, 372, 524, 542; 350/96.27; 359/341

[56] References Cited

U.S. PATENT DOCUMENTS

| | | | |
|---|---|---|---|
| 2,719,241 | 9/1955 | Coltman et al. | 313/373 |
| 3,387,162 | 6/1968 | Schagen et al. | 313/544 |
| 3,712,986 | 1/1973 | Collings | 313/524 |
| 3,981,755 | 9/1976 | Gowers | 313/542 |
| 4,264,408 | 4/1981 | Benham | 313/372 |
| 4,536,421 | 8/1985 | Matsuzawa et al. | 430/313 |
| 4,659,650 | 4/1987 | Moritz et al. | 430/313 |
| 4,687,730 | 8/1987 | Eron | 430/313 |
| 5,038,072 | 8/1991 | Beghin | 313/370 |
| 5,075,200 | 12/1991 | Sugihara et al. | 430/315 |

OTHER PUBLICATIONS

Elliott, D. J., "Integrated Circuit Technology", McGraw-Hill Book Company, 1982, pp. 27-32 and 350-354.

Thompson, Willson and Bowden, "Introduction to Microlithography", ACS Symposium Series, 1983, pp. 181-186.

*Primary Examiner*—Richard L. Schilling
*Assistant Examiner*—Thomas R. Neville
*Attorney, Agent, or Firm*—Paul R. Miller

[57] ABSTRACT

Contact device (10) for the photocathode (11) of photoelectric tubes is produced by a metallic deposit on a substrate (12) intended to receive the photocathode. According to the invention, the contact device (10) is formed by narrow conductive contacts (20) deposited on the useful area (21) of the substrate (12).

5 Claims, 3 Drawing Sheets

Figure 1A:
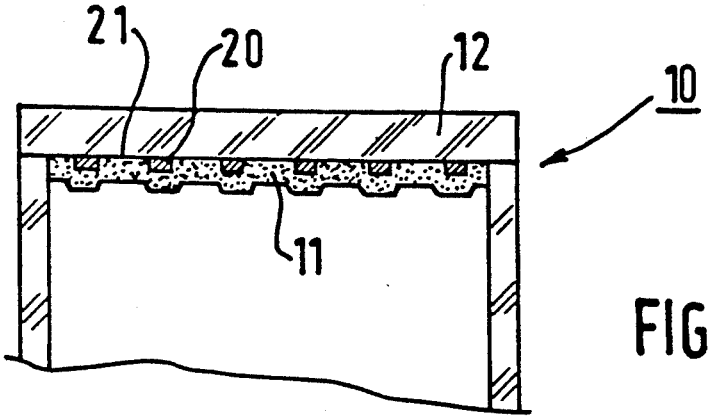

CONTACT DEVICE FOR THE PHOTOCATHODE OF PHOTOELECTRIC TUBES AND MANUFACTURING METHOD

This is a division of application Ser. No. 409.534, filed on Sep. 19, 1989, now U.S. Pat. No. 5,038,072, which was issued Aug. 6, 1991, and all benefits of such patent are hereby claimed for this divisional application.

The present invention relates to a manufacturing method to make a contact device for the photocathode of photoelectric tubes produced by a metallic deposit on a substrate intended to receive the said photocathode.

The invention has a particularly advantageous application in the field of fast image intensifying tubes and ultra-fast slot scanning camera tubes.

The technical problem to be solved for any photocathode contact device for photoelectric tubes, and particularly for fast and ultra-fast tubes, consists in obtaining a fast supply of electrons to the photocathode from the power supply of the tube in order to reduce the time constant RC associated with the photocathode, R being the resistance per unit area of the said photocathode. During operation, the photocathode in fact quickly exhausts itself of photo-electrons, such that it is absolutely essential, if it is desired to operate at high switching frequencies, to regenerate the electrons of the photocathode in a very short time A known solution to this technical problem is the forming of a metallic deposit on a substrate intended to receive the said photocathode in order to constitute a semi-transparent conductive sub-layer made from nickel, nickel-chrome, aluminium or palladium, for example. The quantum efficiency of this known contact device is limited, on the one hand, by the sensitivity of the photocathode itself and, on the other hand, by the optical transmission of the conductive sub-layer/substrate assembly The thickness of this sub-layer is therefore chosen with the intention of providing a correct compromise between the resistivity of the assembly of the two layers (metal and photocathode) and the optical transmission of the sub-layer and of the photocathode. In other words, the thickness of the conductive sub-layer must be sufficient for its resistance per unit area to be rather low, typically 100 to 500 A (angstrom), without however being too great, as in this case, the quantum efficiency of the device would be unacceptably reduced In practice, the necessity for , this compromise does not make it possible to obtain a contact device which is entirely satisfactory, particularly for ultra-fast tubes. Furthermore, this known type of contact device has the disadvantage, because of the relatively high resistivity of the conductive sub-layer, of efficiently injecting the electron-s only at the periphery of the photocathode.

The general technical problem to be solved by one of the objects of the present invention is t-o propose a contact device for the photocathode of photoelectric tubes produced by metallic deposit on a substrate intended to receive the said photocathode, by means of which there is obtained both a high quantum efficiency and a low resistance per unit area which makes possible the injection of electrons into the photocathode in a substantially uniform way over the entire useful area of the photocathode. In a particular embodiment in which the substrate is the end of a bundle of optical fibers having transparent areas of core glass and opaque areas of edge glass, it is desired not to reduce any more the transmission of the device which is already affected by the opacity of the edge glass areas.

The solution to the general technical problem presented consists, according to the present invention, inthat the contact device is formed by narrow conductive contacts deposited on the useful area of the substrate. Thus, by adjusting the width of the said narrow conductive contacts, it is possible to obtain the desired overall transmission, and by giving them a sufficient thickness, the total desired resistance is produced Furthermore, the injection of electrons takes place over the entire useful area of the photocathode and not preferentially on the periphery, which improves uniformity and further limits the response time because the time taken for the electrons to move to the different parts of the photocathode is reduced In the particular embodiment, the narrow conductive contacts are metallic wires deposited on the edge glass areas. Because of this, the initial transmission of the device, associated with the edge glass areas, is not affected by the presence of the narrow conductive contacts.

The method of manufacturing the contact device according to the present invention advantageously puts into practice the technique known as "lift off" and is notable in that there is deposited on the substrate a photo-polymerizable resin which is then irradiated and developed in order to reveal the tracks of the narrow conductive contacts, and in that there is deposited over the entire useful area of the substrate a metallic layer, and then in that, by means of an ultrasonic processing, the remaining resin and the portions of metallic layer situated outside of the tracks is removed, the photocathode then being deposited on the surface of the substrate The following description with reference to the appended drawings, given by way of non-limiting example, will give a good understanding of what the invention consists in and of how it may be embodied FIG. 1*a* is a cross-sectional view of a first photocathode contact device according to the invention.

Figure 1B:
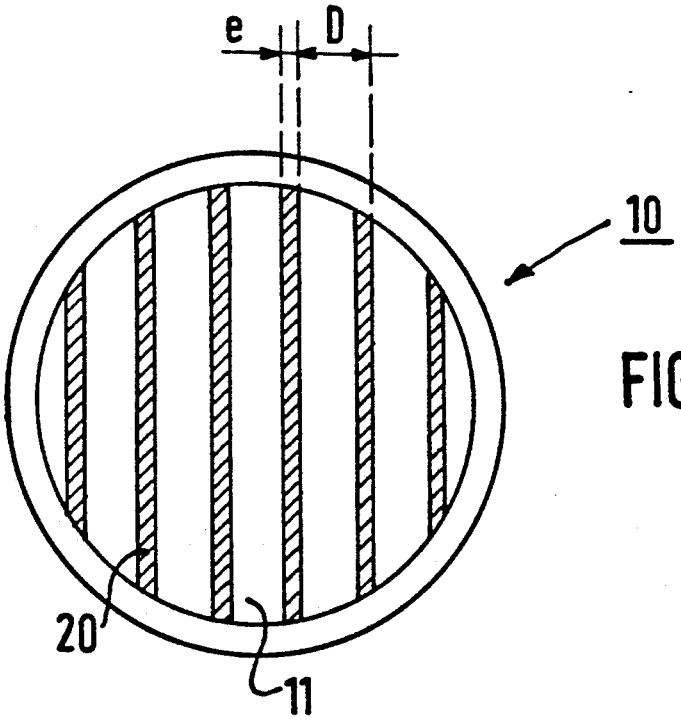

FIG. 1*b* is a plan view of the contact device of FIG. 1*a*.

Figure 2A:
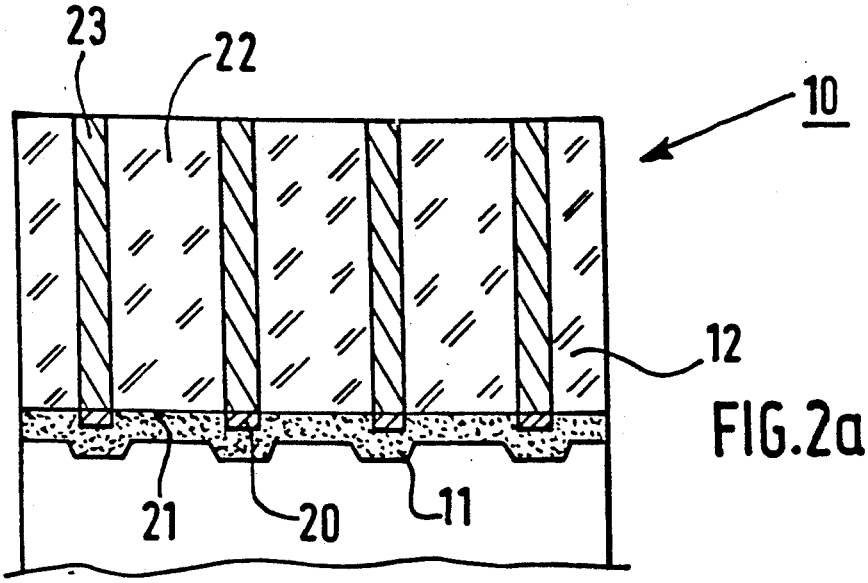

FIG. 2*a* is a cross-sectional view of a second contact device, according to the invention.

Figure 2B:
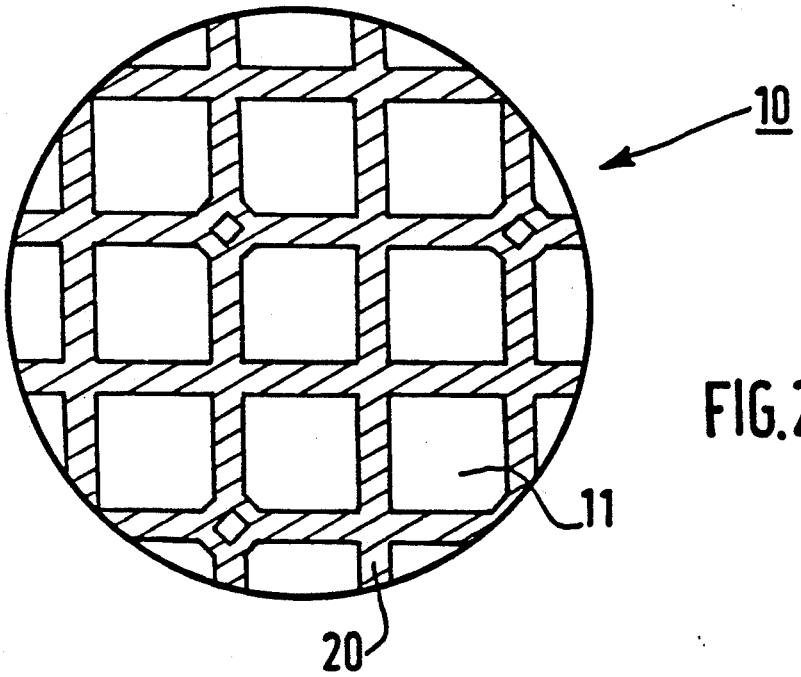

FIG. 2*b* is a plan view of the contact device of FIG. 2*a*.

FIGS. 3*a*, 3*b*, 3*c*, 3*d* and 3*e* illustrate by successive cross-sectional views a manufacturing method for a contact device according to the invention.

FIGS. 1*a* and 1*b* together show, in cross-section and in plan view, a contact device 10 for the photocathode 11 of photoelectric tubes produced by metallic deposit on a substrate 12 intended to receive the photocathode 11. As shown in FIGS. 1*a* and 1*b* in a first embodiment in a the contact device 10 is constituted by narrow conductive contacts 20 deposited on the useful area 21 of the substrate 12 which, in the case of FIGS. 1*a* and 1*b*, is a glass window. These narrow conductive contacts 20 are connected to the electrical power supply of the photoelectric tube comprising the contact device 10. In order to reduce the electrical resistance of the contact device 10 and to increase the speed of the electron exchanges with the photocathode 11, it is possible to give the narrow conductive contacts 20 a thickness which is substantially greater, ten times for example, than the thickness of the metallic sub-layers normally used in the prior art and which must retain sufficient transparency. In this case, the transmission through the narrow conductive contacts 20 themselves is practically zero such that the optical transmission of the contact device is determined by the ratio between the useful area of the substrate 12 occupied by the narrow conductive contacts 20 and the total useful area of this substrate on which the contacts 20 have been deposited In the case in which, as shown in FIGS. 1*a* and 1*b*, the narrow conductive contacts 20 are equidistant parallel wires, the transmission of the device is governed by the ratio between the width e of these wires and the distance D between two consecutive wires Thus, for a width e of 10 A and a distance D of 100 A, the optical transmission of the device will be 90%, while, for the known semitransparent sub-layers, it remains in the order of 60 to 70%, these values being obtained, for example, for a palladium layer of approximate thickness 50 A.

FIGS. 2*a* and 2*b* show a second embodiment of a contact device 10 in which the substrate 12 is the end of a bundle of optical fibers having transparent core glass areas 22 and opaque edge glass areas 23. In this particular embodiment, it is provided that the narrow conductive contacts 20 are metallic wires deposited on the edge glass areas 22. The contact device 10 does not then cause any reduction in transmission.

Figure 3A:
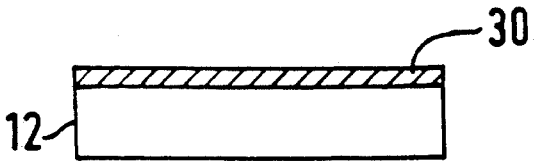
Figure 3B:
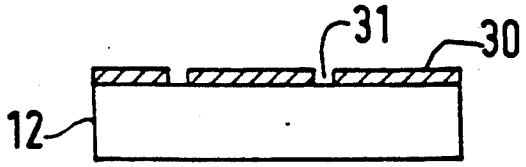
Figure 3C:
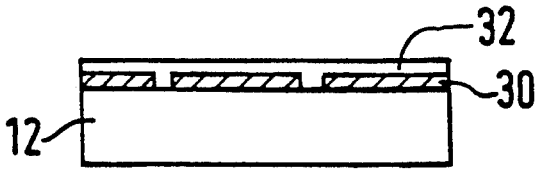
Figure 3D:
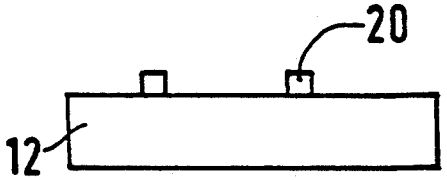
Figure 3E:
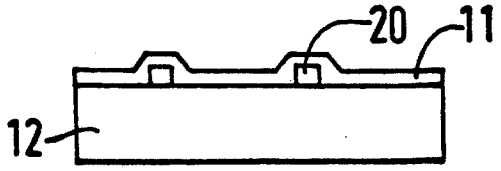

FIGS. 3*a*, 3*b*, 3*c*, 3*d* and 3*e* show the various stages of a method of producing the contact devices described with reference to FIGS. 1*a*, 1*b*, 2*a* and 2*b*. According to this device, there is deposited on the substrate 12 a photopolymerizable resin 30 (FIG. 3*a*) which is then irradiated and then developed in order to reveal the tracks 31 of the narrow conductive contacts 20 (FIG. 3*b*). In the case of FIG. 3 where the substrate 12 is a glass window, a positive photo-polymerizable resin 30 is used and is irradiated through a mask reproducing the said tracks 31. On the other hand, if the substrate is the end of a bundle of optical fibers (FIGS. 2*a* and 2*b*), a negative resin is used with irradiation without a mask through the bundle of optical fibers itself. There is then deposited, over the entire useful area of the substrate 12, a metallic layer 32 which can reach a thickness of several hundred Angstroms (FIG. 3*c*). Then, by means of a processing using ultrasonics and acetone, known as the "lift off" method, the remaining resin and the portions of metallic layer 32 situated outside of the tracks 31 are removed in order to leave on the surface of the substrate 12 only the narrow conductive contacts 20 (FIG. 3*d*). The metals used for forming the metallic layer 32 are the metals which make possible a good bond onto the glass and which do not pollute the photocathodes, namely gold, palladium, nickel-chrome mixture, etc. . . In a final operation (FIG. 3*e*), the photocathode 11 is deposited on the surface of the substrate 12.

I claim:

1. A method of manufacturing a contac: device for a photocathode of photoelectric tubes comprising the steps of (a) depositing a photo-polymerizable resin on a substrate, (b) irradiating said resin to form a plurality of openings relative to said resin, (c) depositing a metallic layer over said substrate to fill said openings, said metallic layer having a firs thickness, (d) removing said metallic layer and said resin except for metal tracks at locations of said openings, said metal tracks having a second smaller thickness, and (e) depositing a photocathode over said substrate and said metal tracks.

2. A method according to claim 1, wherein said step (d) is carried out by ultrasonically etching.

3. A method according to claim 2, wherein said step (a) is carried out by forming said substrate from a bundle of optic fibers having transparent areas of core glass and opaque areas of edge glass, and wherein said metal tracks are formed at said opaque areas of edge glass.

4. A method according to claim 3, wherein ultrasonic etching of said resin is carried out by irradiation through said transparent areas of core glass.

5. A method according to claim 1, wherein said step (c) is carried out by depositing one of gold, palladium, and nickel-chrome mixture.

* * * * *